US007121384B2

(12) United States Patent
Polvilampi

(10) Patent No.: US 7,121,384 B2
(45) Date of Patent: Oct. 17, 2006

(54) TRUCK MAST

(75) Inventor: Janne Polvilampi, Helsinki (FI)

(73) Assignee: Rocla Oyj, Järvenpää (FI)

( * ) Notice: Subject to any disclaimer, the term of this patent is extended or adjusted under 35 U.S.C. 154(b) by 297 days.

(21) Appl. No.: 10/273,937

(22) Filed: Oct. 17, 2002

(65) Prior Publication Data

US 2003/0089555 A1 May 15, 2003

(30) Foreign Application Priority Data

Oct. 19, 2001 (FI) ..... 20012031

(51) Int. Cl.
*B66F 9/08* (2006.01)

(52) U.S. Cl. ..... 187/230; 187/234

(58) Field of Classification Search ..... 187/222, 187/226, 227, 229, 230, 234; 414/495, 592
See application file for complete search history.

(56) References Cited

U.S. PATENT DOCUMENTS

| | | | | |
|---|---|---|---|---|
| 4,432,438 | A * | 2/1984 | Robinson, Jr. | 187/227 |
| 4,458,785 | A * | 7/1984 | Bushnell, Jr. | 187/231 |
| 4,614,253 | A * | 9/1986 | Furukawa | 187/230 |
| 4,635,757 | A * | 1/1987 | Yamagishi et al. | 187/230 |
| 6,193,015 | B1 * | 2/2001 | Kato et al. | 187/226 |
| 6,505,710 | B1 * | 1/2003 | Kato | 187/230 |

FOREIGN PATENT DOCUMENTS

| | | | |
|---|---|---|---|
| DE | 3200287 | | 9/1982 |
| DE | 4023170 | A1 * | 1/1992 |
| EP | 0047137 | | 3/1982 |
| EP | 283 637 | A1 * | 9/1988 |
| EP | 0283637 | | 9/1988 |
| GB | 2118140 | | 10/1983 |
| JP | 03120199 | A * | 5/1991 |
| JP | 10152300 | | 6/1998 |
| SE | 210598 | | 1/1967 |

OTHER PUBLICATIONS

European Standard EN 1726-1, ICS 53.060, "*Safety of industrial trucks—Self-propelled trucks up to and including 10 000 kg capacity and industrial tractors with a drawbar pull up to and including 20 000 N—Part 1: General requirements*," by European Committee for Standardization , Nov. 1998, English version, 84 pages.

(Continued)

*Primary Examiner*—Thomas J. Brahan

(57) ABSTRACT

A two- or multi-stage mast-hydraulic cylinder construction (4, 5) for a truck mast, and method for manufacturing the intergrated structer (4, 5), are disclosed. The fixed mast assembly has its substantially vertical beams (4, 5) and its cylinder liners (29) provide an integrated structure (4, 5), wherein the cylinder liners (29) are constituted by channels integrated inside the beams (4, 5), said integrated structures having their centre of mass at the centre of the cylinder liner (29) or in the immediate vicinity thereof, that the integrated structure (4, 5) is capable of being manufactured by hot extrusion or cold drawing, and that the integrated structure (4, 5) is provided with one flange (13), one side of which comprises a bearing surface (16) and the opposite side comprises a support surface (17), said surfaces (16, 17) lying in a plane transverse to the operating direction of a truck, and with at least one second flange (19) for locating the centre of mass at the centre of the cylinder liner (29) or in the immediate vicinity thereof.

6 Claims, 4 Drawing Sheets

OTHER PUBLICATIONS

European Standard EN 1726-2, ICS 53.060, "*Safety of industrial trucks—Self-propelled trucks up to and including 10 000 kg capacity and industrial tractors with a drawbar pull up to and including 20 000 N—Part 2: Additional requirements for trucks with elevating operator position and trucks specifically designed to travel with elevated loads*," by European Committee for Standardization, Sep. 2000, English version, 29 pages.

* cited by examiner

TRUCK MAST

CROSS REFERENCE TO RELATED APPLICATIONS

This application claims priority under 35 USC §119(e) to Finnish Patent Application No. 20012031 filed on Oct. 19, 2001.

TECHNICAL FIELD

The invention relates to a truck mast. More specifically, the invention concerns a two- or multi-stage truck mast, which is either fixedly or tiltably mounted on a body and which comprises a first pair of substantially vertical beams, connected to each other with at least one substantially horizontal beam, said members providing a fixed mast assembly, the vicinity of said assembly being provided with at least one second pair of substantially co-directional vertical beams, which beams are connected to each other with at least one substantially horizontal beam and which members constitute a carrier adapted to move vertically relative to the fixed mast assembly under the propulsion of pistons in hydraulic cylinders, the drive and power being transmitted therefrom either directly or over chains or cables to the lift carrier, the substantially vertical beams and cylinder liners of said fixed mast assembly providing an integrated structure, wherein the cylinder liners are constituted by channels integrated inside the beams, as well as a method for manufacturing the integrated structure.

BACKGROUND OF THE INVENTION

The term mast truck refers to an industrial truck or forklift mobile on at least three wheels, comprising a mast structure which consists of a fixed mast assembly and a lift carrier. It may further include movable intermediate carriers for increasing the lifting height of a truck or forklift. Thus, there will be two or more stages to the truck. The truck mast connects in a fixed or articulated fashion to the body of a truck as designated in standard EN 1726-1 or EN 1726-2, e.g. FIG. 1. In the mast, such stages or sections are movable relative to each other under the propulsion of pistons in hydraulic separate cylinders, from which the drive and power transmits either directly or over chains or cables to a load-lifting carrier. The mast and its stages constitute a telescopic guide system, wherein the stress is transmitted from the load-lifting carrier over guide rollers to the body structure of a truck. A mast truck is used, among others, for carrying containers, boxes or other such articles e.g. onto storage racks or vice versa.

The mast and carriers of a truck are typically assembled by substantially vertically set sections, such as I-beams, which are connected to each other with cross-members, and said mast and carriers being set in contact with each other to enable the same to travel vertically relative to each other through the intermediary of guide wheel bearings. The outermost intermediate carrier is movable through the intermediary of guide wheel bearings along the sections of a fixed mast assembly in vertical direction. The inner intermediate carriers are respectively movable relative to the outer intermediate carriers and the lift carrier relative to the innermost intermediate carrier. This results in a telescopic structure for lifting goods. The telescopic structure is typically operated by means of hydraulic cylinders.

The intended use of a mast truck entails that the truck should provide as good a visibility as possible in every direction, but it is particularly important to have a field of vision as extensive and unobstructed as possible in the truck driving direction. Further requirements for the truck include a compact size and agility as operation often takes place in cramped storage facilities. The construction used in prior art mast trucks diminishes the driver's visual field in the most important observation direction because of a broad blind area created by a mast structure and lifting cylinders associated therewith. In these currently available mast trucks, the hydraulic cylinders comprise a separate cylinder liner construction and a piston construction and are preferably mounted either alongside or behind the mast construction.

However, the publication DE 32 00 287 A1 discloses a prior known construction, wherein a U-section beam is integrally fitted with a tubular cylinder assembly. It is suggested that the tubular assembly be connected either to the end of a U-section or in the middle of the web on the side facing away from the legs. Manufacturing this prior known structure is nevertheless laborious and expensive.

The solution disclosed in DE 32 00 287 A1 is implementable in practice, e.g. by welding a cylinder-forming tubular structure to a U-section beam. An integral structure manufactured this way will be expensive and the manufacturing requires a multitude of operations demanding accuracy and special skills. Other manufacturing techniques for producing an integral beam as set forth in the cited publication include e.g. casting or machining. However, none of the above manufacturing methods is an economically sound way of making an integral beam. Furthermore, if the cylinder structure is attached to the end of a U-section, the construction will be very long as viewed in the traveling direction of a truck, which in turn leads to poorer handling characteristics for the truck. The most preferred way of manufacturing an integral beam would be by hot extrusion or cold drawing.

A hot extrusible apertured profile is manufactured according to the following operations:

- drilling the initial blank, having a diameter of e.g. 150 mm and a length of 600 mm, for a hole with a diameter of e.g. 50 mm
- heating the initial blank to red heat
- pushing an auxiliary tool through the hole in the initial blank (rod diameter 50 mm)
- pushing the initial blank, along with the auxiliary tool, through a profile form.

If the hole is not in the centre of mass or in the immediate vicinity thereof, the auxiliary tool shall bend and break in the final operation. The same problem is encountered in the process of manufacturing a beam by cold drawing. Due to this requirement introduced by the manufacturing method, the manufacture of beams as disclosed in DE 32 00 287 A1 would have to be performed by adding "counterweight" for placing the centre of mass at the centre of the cylinder hole or in the vicinity thereof. Consequently, the integral beam will be heavy, its production consuming a lot of steel and its external dimensions increasing. On the other hand, the dimensionally increased mast structure obstructs too much of the visual field or has a negative effect on agility of the machine.

SUMMARY OF THE INVENTION

It is an object of the invention to provide a manufacturing method for an integral beam, which is economically viable and which is capable of providing such a product that the blind area in the driver's visual field is small and the mast structure is light. The discussed invention comprises a so-called integral beam for an integrated mast structure, wherein a beam and a cylinder liner are combined for one and the same beam, a bearing assembly for the mast structure, and an economically competitive manufacturing method for the mast structure. The inventive solution is characterized by what is set forth in the annexed claims.

The inventive solution provides advantages over prior art solutions as follows:

The driver's visual field in the most important observation direction increases substantially as the blind area diminishes because a cylinder liner is set within the mast structure. The mechanism becomes simpler, because it has fewer components, resulting in reduced maintenance and manufacturing costs. The manufacture of an integral beam of the invention in series production is economically viable. As physical outer dimensions, i.e. length and width, become smaller, the mast truck will be more agile to handle and easier to maneuver in cramped storage facilities. The inventive integral beam is also capable of providing a highly favourable rigidity/weight ratio. In addition, a bearing system for the beams can be provided in a simpler fashion.

The inventive integral beam is preferably manufactured by hot extrusion or cold drawing of steel. The integral beam has its cylinder hole positioned at the centre of mass in the cross-section of the integral beam, or in the immediate vicinity thereof, most preferably at the precise centre of mass. A deviation from this causes immediately problems in hot extrusion or cold drawing and, depending on process parameters, disables the method completely at some point. Therefore, the solutions disclosed in DE 32 00 287 A1 are not implementable with the discussed manufacturing techniques.

BRIEF DESCRIPTION OF THE DRAWINGS

The invention will now be described in more detail with reference to the accompanying drawings, in which.

BEST MODE FOR CARRYING OUT THE INVENTION

Figure 1:
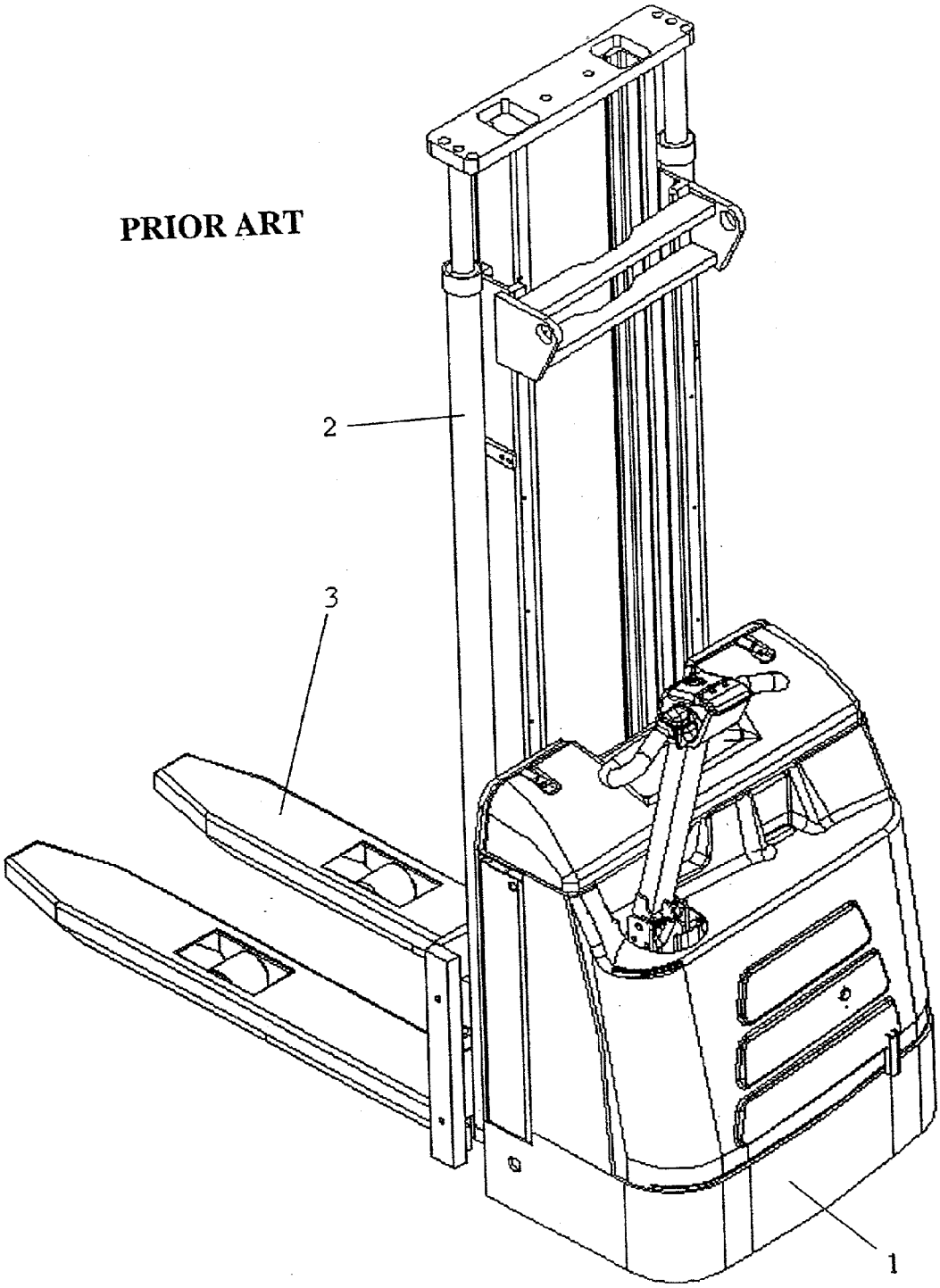
FIG. 1 shows a prior art mast truck in principle in a lateral 3-D view.

FIG. 1 illustrates one prior known variant for a mast truck. A mast truck body 1 is fitted with a mast assembly and hydraulic cylinder construction 2 for raising a left carrier 3. In this case, the lift carrier 3 comprises a forklift carrier. Raising of the lift carrier 3 proceeds in two or more stages, depending on the particular mast assembly.

Figure 2:
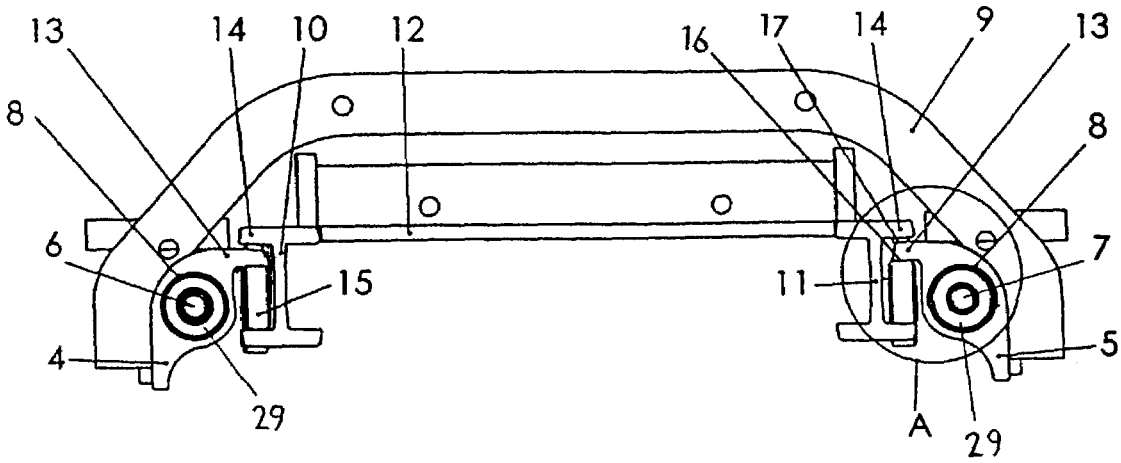
FIG. 2 shows from above a mast structure of the invention in cross-section, wherein cylinder liners are integrated with the mast structure.

FIG. 2 depicts a mast assembly for a mast truck of the invention in cross-section and in a plan view. It illustrates integrally designed, substantially vertical beams or uprights 4 and 5, which include built-in cylinder liners 29, along with pistons 6 and 7 therefor. The cylinder liners 29 are in the form of holes extending lengthwise through the integral beams 4 and 5, which are sealed, for example at the bottom thereof, with a pressure bushing or a plug and provided at the top thereof with packing boxes 8 for sealing and guiding the pistons 6 and 7. The beams 4 and 5 are connected to each other with a substantially horizontal cross-member 9. Inside the beams or uprights 4 and 5, viewed in a widthwise direction of the mast truck, is mounted an intermediate carrier, comprising substantially vertical I-sections 10 and 11 and a substantially crosswise member 12. The integral beams 4 and 5 are provided with a flange 13, said flange being fitted respectively between a flange 14 of the intermediate carrier's I-sections 10 and 11 and a bearing system 15 for operating the intermediate carrier in the vertical direction. The flange 13 has its opposite surface provide a bearing surface 16 as well as a support surface 17. The integrally constructed beams 4 and 5 can be mounted on the body of a mast truck either fixedly or tiltably.

Figure 3:
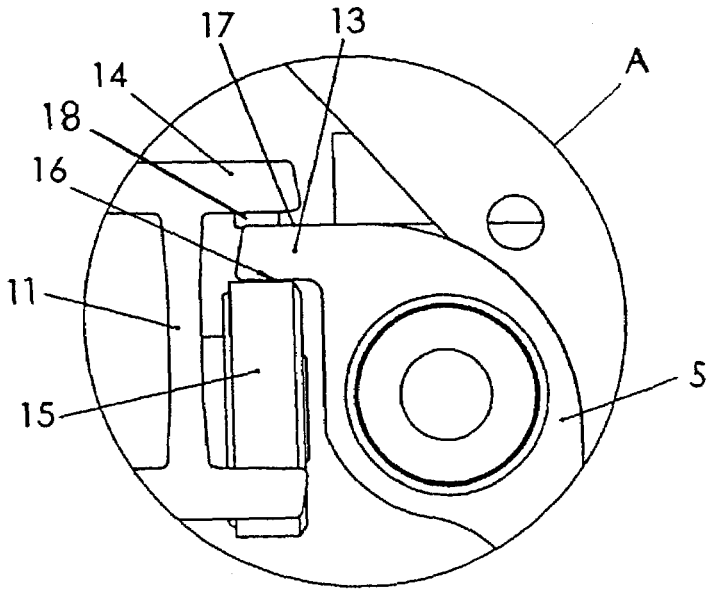
FIG. 3 shows an enlarged view of a detail A in FIG. 2, regarding a bearing system and bracing for the mast structure.

FIG. 3 shows a detail A in FIG. 2 in an enlarged view, wherein the bearing system 15 and the bracing 17 for a mast assembly is visualized more clearly. The I-section beam 11 has its bracing 17 arranged by the use of just one flange 13 of the integral beam 5. The bearing 15, which is preferably a rolling contact bearing, travels along the inner surface 16 of the flange 13 for operating the intermediate carrier and the flange's outer support surface 17 bears against a piece 18 fitted to the I-section's flange 14, which piece 18 is preferably a screw or a like to optimize the clearance. Bracing of the I-section beam 11 is primarily effected by means of the bearing system 15 against the bearing surface 16 of the integral beam 5, and the bracing 17 present on the opposite side of the flange 13 only functions e.g. during a take-off, at which time the I-section beam momentarily leans in the opposite direction. The inner and outer surfaces 16 and 17 of the flange 13 are substantially parallel to the operating direction of a truck. The possible difference is due to a better operating performance of the truck. The outer surface 17 continues and turns around the cylinder liner 29 for 90 degrees. The support of the integrally constructed beams 4 and 5 is also possible to arrange in that curved area. Preferably it is arranned in straight surface 17 of the flange 13.

Figure 4:
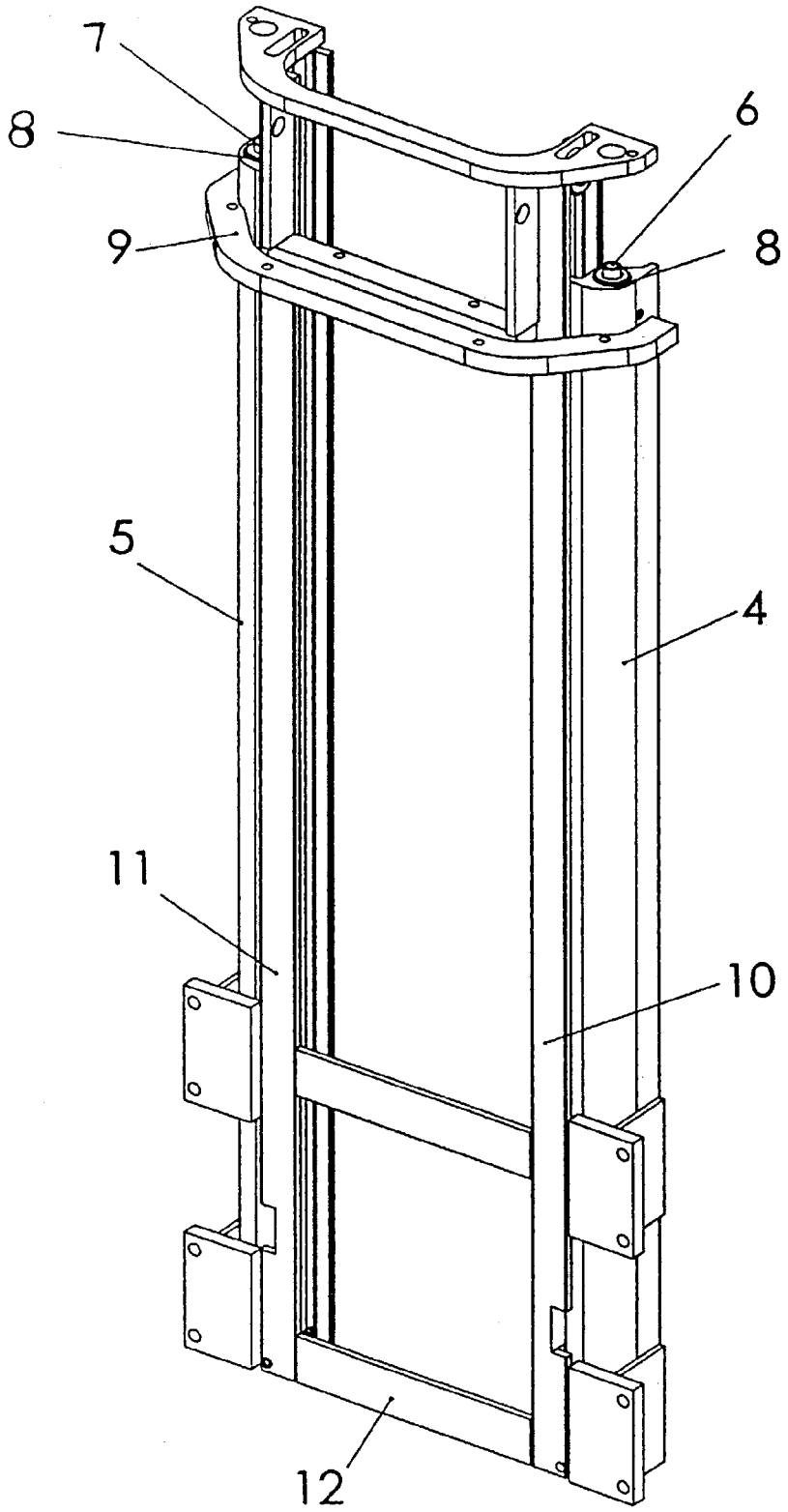
FIG. 4 shows the mast structure of FIG. 2 illustrated at an angle from the front and above.

FIG. 4 illustrates the mast assembly of FIG. 2 obliquely from the front and above. At the top of the beams 4 and 5, along the inner surface of the cylinder liners, is preferably a machined area which is fitted, after manufacturing the sections, with separate packing boxes 8 for guiding the pistons 6 and 7. Depending on a particular construction, the packing boxes 8 are placed either at the top or at the bottom of the beams 4 and 5, whereby the pistons 6 and 7 are capable of moving either downward or upward, respectively. At the opposite ends thereof, the cylinder liners are sealed with a pressure bushing or a plug. Consequently, the manufacturing tolerances for an integral beam can be slightly relaxed. Packing between the pistons 6 and 7 and the cylinder liner can also be implemented in some other, prior known fashion.

The integrated structures 4 and 5, consisting of a mast assembly, cylinder liners, and the pistons 6 and 7, diminish the blind area in the driver's visual field and do not increase the length of a mast truck relative to its operating direction. An additional benefit is a simpler and lighter construction, which has an improved rigidity/weight ratio and which has fewer components. Fewer components result in lower manufacturing costs. Moreover, by virtue of the integral beam design, the manufacture of a beam can be performed by exploiting some economically viable manufacturing technique, such as hot extrusion or cold drawing. These above-mentioned manufacturing techniques require that the cross-sectional centre of mass of an integral beam be located at the centre of a cylinder liner, or in the immediate vicinity thereof.

Figure 5:
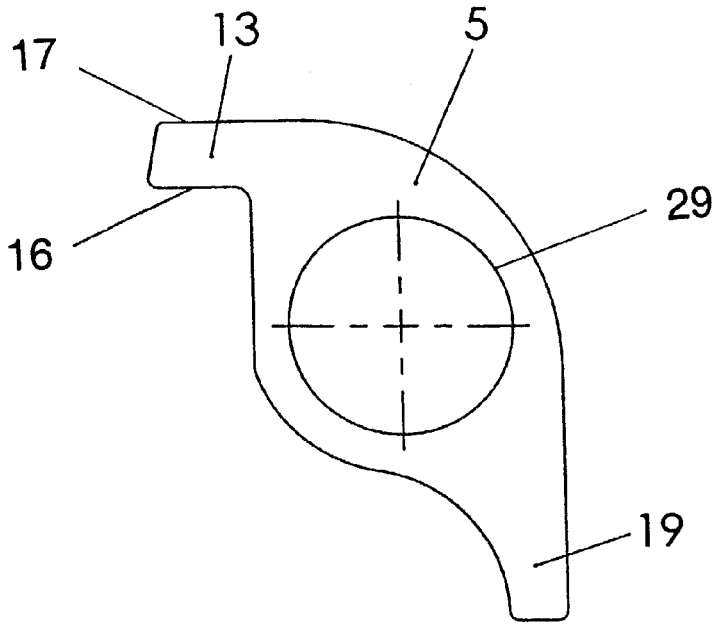
FIG. 5 shows an integral beam of the invention in cross-section.

FIG. 5 discloses a cross-section for the inventive integral beam 5. The integral beam 5 has its centre of mass located at the centre of a cylinder liner 29, whereby manufacturing of the beam is possible by hot extrusion or cold drawing. For the purpose of mounting with bearings and bracing, the integral beam or upright 5 includes the flange 13 and, for the purpose of locating the centre of mass, a flange 19. The mounting with bearings of the integral beam 5 is effected by bearing against the surface 16 and the bracing is effected by bearing against the surface 17. The structure has an elongated outline in the operating direction of a mast truck, giving the structure an excellent torsional rigidity, which is vital regarding operation of the mast assembly.

Figure 6:
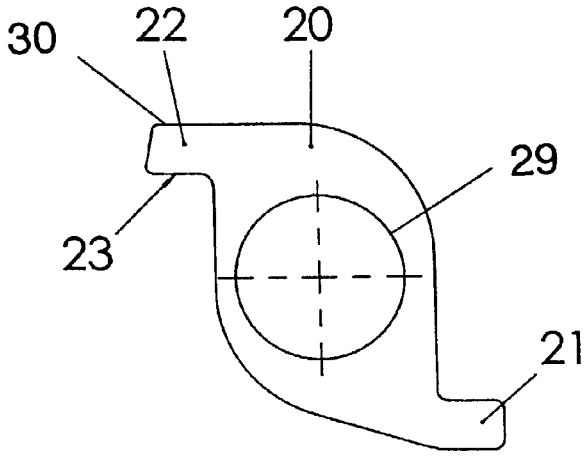
FIGS. 6 and 7 show cross-sections for an integral beam of the invention in two other preferred embodiments.

FIG. 6 shows in cross-section another preferred embodiment for an integral beam 20 that can be manufactured by hot extrusion or cold drawing. The beam 20 has one 21 of its flanges turned 90 degrees counterclockwise with respect to the flange 19 of the beam 5 in FIGS. 2, 3, 4 and 5. Like above, the bearing system in this case is arranged the same way as with the beam 5 shown in the preceding figures in a one-sided manner along an outer surface 23 present in a flange 22 of the integral beam 20. Bracing is effected by way of an opposite surface 30 of the flange 22. The bracing can be arranged also on the curved surface of the beam 20 in the same way as with the beam 5 in FIG. 3. However, the characteristics achieved by this arrangement regarding torsional rigidity in the operating direction of a truck are not quite as excellent as those achieved with the beam 5 of FIG. 5. In this embodiment, as well, the centre of mass is located, in compliance with the requirements of a manufacturing method, in the middle of a cylinder liner 29 of the integral beam 20.

Figure 7:
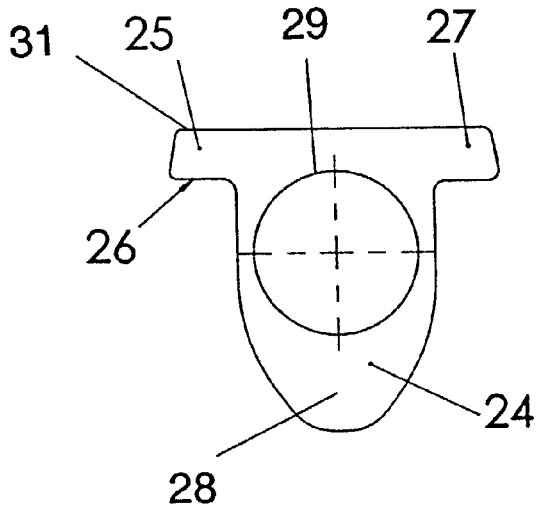

FIG. 7 illustrates yet another preferred cross-sectional embodiment for an integral beam 24 that can be manufactured by hot extrusion or cold drawing. It has been produced by combining a cylinder liner 29 with the middle portion of a member having a substantially rectangular cross-section, one end of which, a flange 25, can be provided with a bearing surface 26 and the other end of which constitutes a second flange 27. Thus, in order to locate the centre of mass in the middle of the cylinder liner 29, it is necessary to place more mass on a wall of the cylinder liner to provide a flange 28 on the opposite side relative to said rectangle. In this embodiment, as well, the bearing system is only arranged in a one-sided manner along the surface 26 of the flange 25, and bracing is effected by way of an opposite surface 31 of the flange 25.

Manufacturing an integral beam 5 having the cross-section shown in FIG. 5 consumes appr. 27 kg/m of steel. The corresponding integral beams set forth in DE 32 00 287 A1, manufactured by hot extrusion, consume appr. 50 kg/m of steel. Since the price of steel beams per unit of length results directly from the amount of raw material used per unit of length, it is obvious that the solutions set forth in the cited publication are not economically viable when the manufacturing process is hot extrusion or cold drawing. In addition, the necessary additions to mass also increase the external dimensions of an integral beam, with the result that the beam again blocks a major part of the driver's visual field. As pointed out in the foregoing, the manufacturing e.g. by welding is not an economically competitive solution, either.

There are many possibilities of fitting a cylinder liner inside a section of the mast assembly. The figures only illustrate a few preferred compositions for integral beams that can be manufactured by hot extrusion or cold drawing. However, it is obvious for a person skilled in the art that a number of options exist for implementing the structure and that the scope of protection is more precisely defined by the following claims.

What is claimed is:

1. A two-or multi-stage truck mast for a truck, wherein said two- or multi-stage truck mast is either fixedly or tiltably mounted on a body and which comprises a first pair of substantially vertical beams, connected to each other with at least one substantially horizontal beam, said first pair of vertical beams and said at least one substantially horizontal beam and cylinder liners forming a fixed mast assembly, the vicinity of said assembly being provided with at least one second pair of substantially co-directional vertical beams that are connected to each other with at least one second substantially horizontal beam, wherein said at least one second pair of substantially co-directional vertical beams and said at least one second substantially horizontal beam forming a lift carrier adapted to move vertically relative to the fixed mast assembly under the propulsion of pistons in hydraulic cylinders, the drive and power being transmitted directly or over chains or cables to the lift carrier, the first pair of substantially vertical beams and cylinder liners of said fixed mast assembly providing an integrated structure, wherein the cylinder liners are constituted by channels integrated inside the first pair of vertical beams, which integrated structure has its cross-sectional centre of mass located at the centre of the corresponding cylinder liner or in the inimediate vicinity thereof, such that the integrated structure is capable of being manufactured by hot extrusion or cold drawing, wherein the integrated structure comprises:

a first flange, which comprises mainly parallel surfaces, lying in a plane substantially transverse to an operating direction of the truck, an inner surface of said first flange being a bearing surface of a rolling contact bearing and an outer surface or an adjacent outer surface of the integrated structure being a support surface, and at least one second flange for placing the centre of mass substantially at the centre of the corresponding cylinder liner.

2. A truck mast as set forth in claim 1, characterized in that pairs of the flanges are situated at opposite sides of the respective cylinder liners.

3. A truck mast as set forth in claim 2, characterized in that the first flange of the integrated structure is provided with the bearing surface and the opposite support surface and the second flange being at a right angle to the first flange.

4. A truck mast as set forth in claim 2, characterized in that the first flange of the integrated structure is provided with the bearing surface and an opposite support surface and the second flange are directed in opposite directions relative to each other, and that a wall of the cylinder liner opposite with respect to the flanges is provided with additional material so as to increase its thickness in such a way that it constitutes a third flange.

5. A two- or multi-stage truck mast for a truck, wherein said two- or multi-stage truck mast is either fixedly or tiltably mounted on a body and which includes a first pair of substantially vertical beams, connected to each other with at least one substantially horizontal beam, said first pair of vertical beams and said at least one substantially horizontal beam and cylinder liners forming a fixed mast assembly, the vicinity of said assembly being provided with at least one second pair of substantially co-directional vertical beams that are connected to each other with at least one second substantially horizontal beam, wherein said at least one second pair of substantially co-directional vertical beams and said at least one second substantially horizontal beam forming a lift carrier adapted to move vertically relative to the fixed mast assembly under the propulsion of pistons in hydraulic cylinders, the drive and power being transmitted directly or over chains or cables to the lift carrier, the first pair of substantially vertical beams and cylinder liners of said fixed mast assembly providing an integrated structure, wherein the cylinder liners are constituted by channels integrated inside the first pair of vertical beams, which integrated structure has its cross-sectional centre of mass located at the centre of the corresponding cylinder liner or in the immediate vicinity thereof, such that the integrated structure is capable of being manufactured by hot extrusion or cold drawing, characterized in that the integrated structure comprises:

a first flange having mainly parallel surfaces lying in a plane substantially transverse to an operating direction of the truck, an inner surface of said first flange being a bearing surface of a rolling contact bearing and an outer surface or an adjacent outer surface of the integrated structure being a support surface; and at least one second flange for placing the centre of mass substantially at the centre of the corresponding cylinder liner, wherein the flanges are situated at opposite sides of the cylinder liner, and wherein the first flange of the integrated structure is provided with the bearing surface and the opposite support surface and the second flange are directed in opposite directions relative to each other.

6. A method for manufacturing by hot extrusion or cold drawing an integrated structure for a truck mast, the integrated structure including a first pair of substantially vertical beams and cylinder liners of a fixed mast assembly, the method comprising:

locating the centre of mass of the integrated structure substantially in the middle of a cylinder liner; and forming the integrated structure with one flange, having an I-section beam bearing-mounted on an inner surface of the flange with a rolling contact bearing, the flange having an outer surface or the adjacent outer part of the integrated structure adapted as a support surface, and with at least one second flange.

* * * * *